US005889247A

United States Patent [19]

Homol

[11] Patent Number: 5,889,247

[45] Date of Patent: Mar. 30, 1999

[54] NORMALLY CLOSED, PRESSURE RESPONSIVE ELECTRICAL SWITCH

[75] Inventor: Stanley G. Homol, Taunton, Mass.

[73] Assignee: Texas Instruments Incorporated, Dallas, Tex.

[21] Appl. No.: 842,858

[22] Filed: Apr. 17, 1997

[51] Int. Cl.[6] ..... H01H 35/34

[52] U.S. Cl. ..... 200/83 P; 200/83 J

[58] Field of Search ..... 92/5 R, 98 R; 73/723, 745, 861.47; 340/626; 307/118; 200/302.1, 275, 279, 82 R, 83 R, 83 N, 83 P, 83 J, 83 Y

[56] References Cited

U.S. PATENT DOCUMENTS

| | | | |
|---|---|---|---|
| 4,948,931 | 8/1990 | Nixon | 200/83 P |
| 5,015,808 | 5/1991 | Czarn | 200/83 P |
| 5,049,708 | 9/1991 | Baker . | |
| 5,278,367 | 1/1994 | Homol | 200/83 J |
| 5,508,483 | 4/1996 | Czarn et al. . | |
| 5,708,245 | 1/1998 | Werner | 200/83 P |

*Primary Examiner*—Gerald P. Tolin
*Attorney, Agent, or Firm*—Russell E. Baumann; Richard L. Donaldson; Rene' E. Grossman

[57] ABSTRACT

A normally closed, fluid pressure responsive electric switch (10) has an electrically conductive body (12) formed with an orifice (12*a*) leading to a pressure chamber (12*c*) which is separated from a switch chamber by a flexible member (14). An annular support plate (18) and disc seat (20) are sandwiched in the body by crimping distal free end (12*g*) of body (12) over the flange (26*b*) of a connector body (26). A pressure/force converter (22) has a plurality of outwardly extending fingers which are interdigitated with a corresponding number of fingers extending inwardly from an aperture in the disc seat. The converter has one end (18*b*) engaging the membrane and an opposite end having a circular force applying surface (22*g*) adapted to engage a snap acting disc (24) disposed on the disc seat within a recess formed in the connector body. The disc is centered by a centering lip (22*e*) formed on the converter fingers. A terminal (28) extends through the connector base (26) and has a terminal rib (28*e*) which engages the opposite side of the disc forming an electric path from the terminal through the terminal rib to the disc and from the disc to the disc seat in one of two opposite configurations of the disc and from the disc seat to body (12) through deformed portions (12*h*) of the body wall (12*f*). In an alternate embodiment a two terminal switch (10') is provided by placing a second terminal (34) in electrical engagement with disc seat (20') and electrically isolating the disc seat from the body (12).

13 Claims, 3 Drawing Sheets

NORMALLY CLOSED, PRESSURE RESPONSIVE ELECTRICAL SWITCH

FIELD OF THE INVENTION

This invention relates generally to fluid pressure responsive electric switches used to monitor the pressure level of a fluid pressure source and more particularly to such switches which are in the closed circuit condition at fluid pressure levels below a selected level which switch to an open circuit condition at fluid pressure levels above the selected level.

BACKGROUND OF THE INVENTION

U.S. Pat. No. 5,508,483, assigned to the assignee of the present invention, discloses a normally open, fluid pressure responsive electrical switch, used, for example, to monitor automotive hydraulic fluid to provide signals to the engine control module (ECM) of a vehicle responsive to power steering demand so that engine speed can be increased when required to prevent stalling. The switch comprises a housing member having a fluid receiving orifice extending into a recess forming a fluid chamber in the housing member. A flexible membrane is disposed over the recess with an annular support plate held against the diaphragm by the metallic outer portion of an eyelet which also serves as a disc seat for an electrically conductive snap acting disc. A force/pressure converter has a piston portion received through the center of the annular support plate to engage the membrane at one end and an opposite end is provided with a circular force applying surface adapted to engage a disc mounted on the disc seat. A terminal post is mounted in the eyelet electrically isolated from the outer portion thereof and is provided with a continuous or segmented circular stationary electrical contact. The snap acting disc has a convex configuration facing the converter and out of engagement with the stationary electrical contact when subjected to fluid pressures below a selected level which will snap to an opposite, concave configuration facing the converter and in electrical engagement with the stationary electrical contact when subjected to fluid pressure above the selected level.

SUMMARY OF THE INVENTION

It is an object of the present invention to provide a normally closed, fluid pressure responsive electric switch for use as a pump mounted, automotive power steering pressure switch. Another object is the provision of a normally closed fluid pressure responsive electric switch useful in various hydraulic or pneumatic applications including automotive, industrial, aerospace and appliance businesses which can be manufactured in high volumes and which includes selected pressure amplification from the disc relative to the switch as a whole with an improved pressure converter to prevent over-stressing of the disc and to provide improved life of a diaphragm separating the fluid pressure chamber from the electro-mechanical switch components. Another object is the provision of such a switch having structure which allows improved assembly techniques and disc location. Yet another object is the provision of an improved grounding feature for such switch.

Briefly described, a normally closed, fluid pressure responsive electric switch made in accordance with the invention comprises a body having an orifice leading to a fluid pressure chamber with a flexible diaphragm disposed on a shelf in the body to separate the fluid pressure chamber from a switch chamber. One side of an annular support plate is placed on the shelf over the membrane and one side of an electrically conductive disc seat is placed on the opposite side of the support plate. The disc seat is formed with a non-circular aperture extending therethrough aligned with the circular bore of the annular support plate. The non-circular bore includes a plurality of fingers extending radially inwardly which are interdigitated with a plurality of fingers extending radially outwardly from a pressure/force converter slidably received in the non-circular bore. The pressure/force converter has one end portion slidably received in the circular bore of the annular support plate in engagement with the flexible membrane and an opposite end face formed with a circular force applying surface of a selected diameter. A base of electrically insulative material has one end received on a second side of the disc seat and is clamped to the body by virtue of a wall portion of the body bent radially inwardly over a flange portion of the base. An elongated terminal member is mounted in the base member and extends from an exterior location through the base into a recess formed in the said one end of the base. The portion of the terminal disposed in the recess includes a segment of a circular terminal rib having a selected diameter lying in a plane generally parallel with a plane in which the disc receiving surface of the disc seat lies. A snap acting, electrically conductive, thermostatic disc disposed on the disc receiving surface has a convex dished shape configuration facing the terminal rib and in electrical engagement therewith at fluid pressure levels below a selected level to form a closed electric circuit extending from the body, through the disc seat and through the thermostatic disc to the terminal. At fluid pressure levels above the selected level, force exerted by the converter causes the disc to snap to an oppositely dished, concave configuration facing the terminal rib with the outer periphery of the disc lifted by the converter to a position out of engagement with the disc seat to open the circuit.

According to a feature of the invention, the diameters of the force applying surface of the converter and the terminal rib are selected to provide a desired disc to switch amplification by selecting an appropriate lever arm between the contact locations. According to another feature of the invention, the converter is formed with a shallow concave configuration within the circular force applying surface to provide support for and prevent over-stressing of the disc. According to yet another feature of the invention, travel of the disc both before and after snapping is limited relative to the movement of a free disc thereby improving membrane life. According to another feature, the fingers of the converter and the disc seat are interdigitated providing discrete contact locations with concomitant concentration of electrical contact force at those locations. According to still another feature, the distal free end of the converter fingers are provided with a disc centering lip to align the disc during and after assembly of the switch and prevent radial motion of the disc relative to the converter thereby reducing the amount of variability in the set point of the switch and minimizing the generation of wear particles at this interface. Another feature of the invention is the provision of an improved body ground path wherein the body is deformed by a force exerted from a location exterior to the switch cavity into the disc seat at a plurality of locations around the periphery thereof thereby preventing any particles created by the deforming tools from causing contamination within the switch cavity. According to a modified embodiment, for applications where a discrete circuit is desired, an additional elongated terminal is mounted in the base member and is electrically connected to the disc seat. In this embodiment the disc seat is spaced from the body wall by a spacer wall portion of the base member and a separate insulating spacer is disposed between the disc seat and the annular support plate.

These and other advantages and features of the invention will become apparent from the following description of the preferred embodiments of the invention with reference to the accompanying drawings. Dimensions may have been modified in the drawings for the purpose of illustration.

DETAILED DESCRIPTION OF PREFERRED EMBODIMENTS

Figure 1:
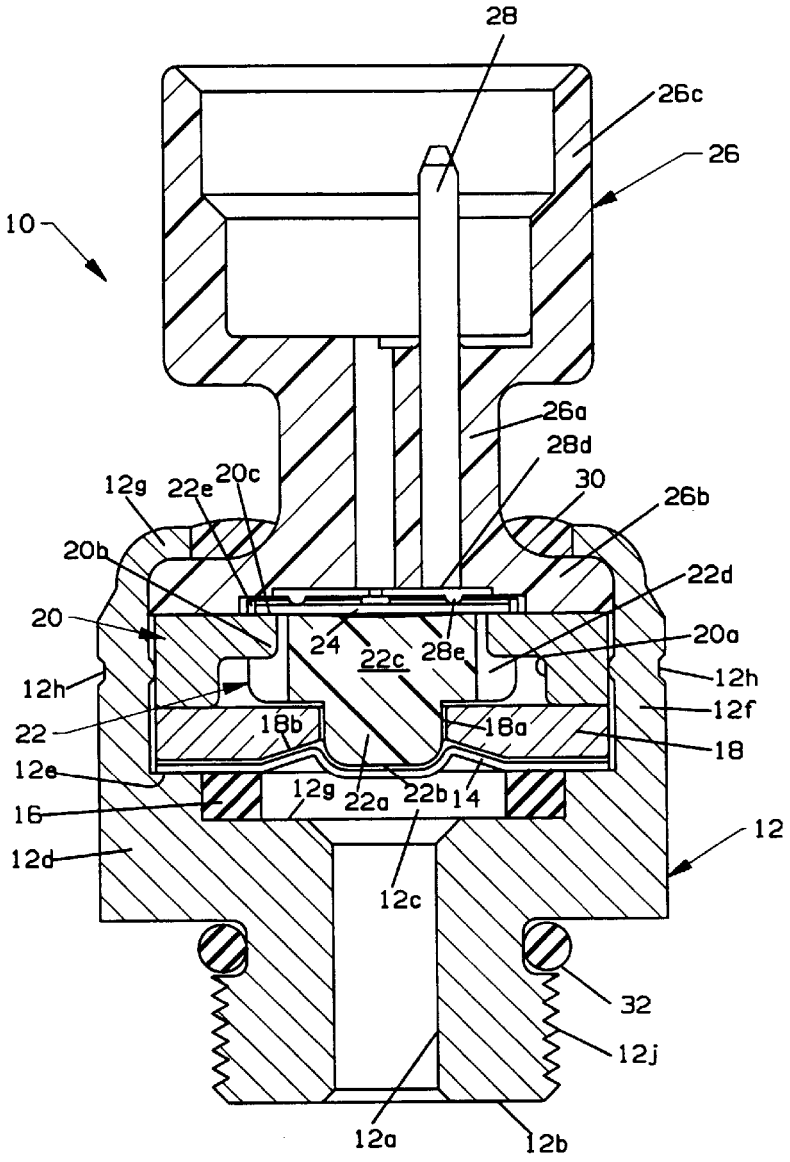
FIG. 1 is a cross section of an elevational view of a normally closed, fluid pressure responsive electric switch made in accordance with the invention.

With reference to FIG. 1, a normally closed, fluid pressure responsive electric switch 10 made in accordance with the invention comprises an electrically conductive body member 12 formed with an orifice 12*a* at a first end 12*b* which leads to a fluid pressure chamber 12*c* at a central portion 12*d* of the body member. Body member 12 has threaded portion 12*j* for reception in a threaded port of a fluid pressure system to be monitored. A central portion 12*d* is preferably hexagonal to facilitate installation and removal from such threaded ports. A shelf 12*e* is formed in the central portion 12*d* with a flexible membrane 14 of suitable impervious resinous material, such as polyimide, disposed on the shelf separating the fluid pressure chamber from a switch chamber defined by upstanding cylindrical wall 12*f*. An elastomeric gasket 16 or the like is placed in the pressure chamber between membrane 14 and bottom wall 12*g* of the pressure chamber to form an effective fluid tight seal when compressed after the remaining components have been assembled.

An annular support plate 18 of any suitable material is received on shelf 12*e* on top of membrane 14 and is provided with a centrally disposed bore 18*a* and tapered surface 18*b* leading from the bottom surface as seen in FIG. 1 to the bore to provide an optimum, smooth support surface for membrane 14.

Figure 5:
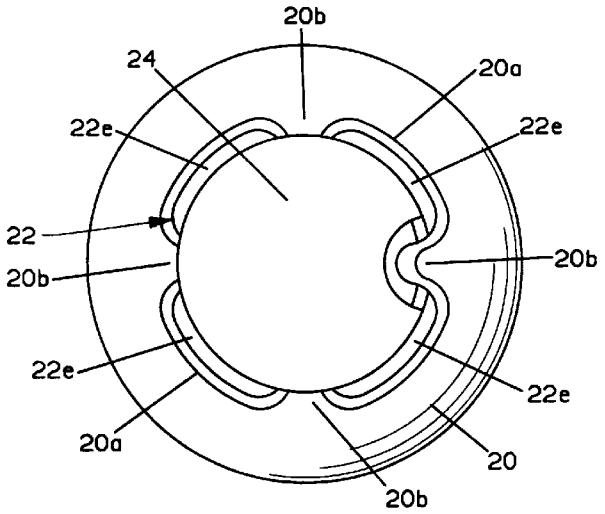
FIG. 5 is a top view of the FIG. 4 structure.

A disc seat 20 formed of electrically conductive material is received on the upper surface of support plate 18 and, as best seen in FIG. 5, is provided with a non-circular aperture 20*a* having a plurality of spaced apart fingers 20*b* extending radially inwardly.

A pressure/force converter 22 formed of suitable electrically insulative material, such as plastic, has a first generally cylindrical end portion 22*a* slidably received in bore 18*a* of support plate 18 with an end surface 18*b* adapted for engagement with membrane 14. Converter 22 has a second, opposite end portion 22*c* received in aperture 20*a* of disc seat 20 formed with a plurality of spaced apart fingers 22*d* which extend radially outwardly and are interdigitated with fingers 20*b* of the disc seat. A disc centering lip 22*e* is formed at the distal free end of each converter finger 22*d* extending upwardly in an axial direction, as seen in FIGS. 1–4. Converter 22 is also formed with a slightly concave end surface configuration 22*f*, best seen in FIG. 4, to prevent over-stressing of a disc to be discussed below.

An electrically conductive, snap acting disc 24 is received on disc seat 20 which is maintained in an axially centered position by disc centering lips 22*e* of converter 22. Disc 24 is movable between a first concave configuration facing the converter at pressures below a selected level and a second convex configuration facing the converter at pressures above the selected level.

Figure 1A:
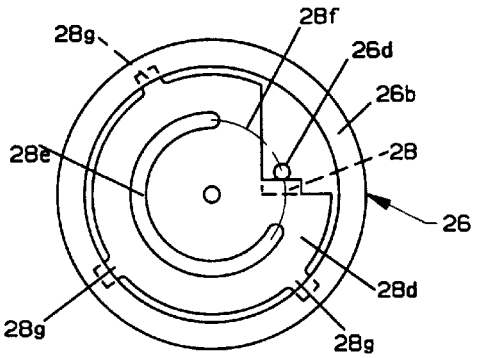
FIG. 1*a* is a bottom view of the connector base member shown in FIG. 1.

A connector base member 26 formed of suitable electrically insulative material, such as a moldable resinous material, has a necked down central portion 26*a* which forms a radially outward extending flange portion 26*b* at a first end which is received on disc seat 20. An elongated terminal 28 is mounted in base 26 and extends from a location externally of the base within shroud 26*c* into a recess formed at the first end of the base where a terminal plate 28*d* lies in a plane generally parallel to a plane formed by the surface 20*c* of disc seat 20 in which disc 24 lies. A contact surface in the form of a generally circular terminal rib 28*e* is axially located at a selected location relative to the disc supporting surface 20*c* in order to electrically engage disc 24. As seen in FIGS. 1 and 1*a*, terminal 28 and terminal plate 28*d* are integrally formed with terminal 28 bent 90 degrees out of the plane in which terminal plate 28*d* lies. In the embodiment shown, terminal rib 28*e* is formed into an incomplete circle, i.e., a segment of a circle, due to space restraints. In order to balance forces placed on disc 24 and avoid undesired stresses in the disc, a projection 26*d* is formed in base member 26 extending into the recess formed at the first end of the base to a height generally matching the height of terminal rib 28*e*, when in place, and aligned with the imaginary continuation of terminal rib 28*e* as indicated by broken line 28*f*. Terminal plate 28*d* is preferably formed with tabs 28*g* which are insert molded into the base member to lock terminal plate 28*d* firmly in place. The plane on which surface 20*c* of disc seat 20 lies is spaced apart from terminal rib 28*e* a distance selected to place a selected force on disc 24 when in the FIG. 1 contacts closed position, to be discussed further below. On the opposite side of disc 24, converter 22 has a circular force applying edge 22*g* (see FIG. 4) surrounding the recessed, concave configuration 22*f* which engages disc 24 and which has a diameter selected relative to the diameter of terminal rib 28*e* to provide a desired level of amplification of the force transmitted by the converter. That is, the effective length of the lever arm between the force to applying surface 22*g* and the terminal rib 28*e* can be adjusted by choosing the appropriate diameters thereof, particularly the diameter of rib 28*e*.

The outer free end 12*g* of body sidewall 12*f* is crimped inwardly over flange 26*b* to clamp the components together and a sealant 30 of suitable epoxy is then placed around the clamped connection to provide a fluid tight seal.

Sidewall 12*f* is deformed inwardly at a plurality of locations 12*h* into firm physical engagement with the outer periphery of disc seat 20 in order to provide a good electrical connection between the body 12 and disc seat 20. This provides an effective electrical connection without having to be concerned with debris and the like possibly contaminating the switch chamber which might occur if the disc seat were staked from inside the switch chamber. Switch 10, as described, is a normally closed, body ground switch with an electric path from terminal 28 through terminal rib 28*e* to disc 24, through the disc to disc seat 20, and from the disc seat to hexagonal body 12 at the sidewall stakes 12*h*.

Figure 7:
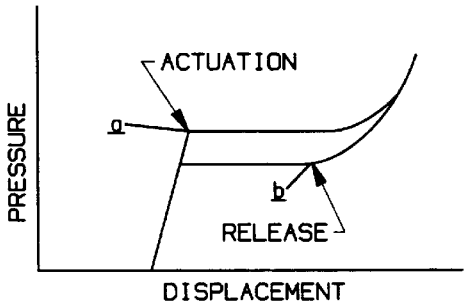

In use, the switch is mounted via hexagonal portion 12*d*, threaded portion 12*j* and O-ring 32 to a fluid pressure circuit to be monitored with membrane 14 in intimate contact with the fluid pressure source. As system pressure is increased, the membrane will be deflected up against the converter which is allowed to move axially until it engages disc 24. At this point, movement of membrane 14, converter 22 and disc 24 will be as shown in FIG. 7 which shows a curve of displacement vs. pressure for the switch as a whole. It can be seen from the curve that there is negligible deflection of the membrane, converter and disc until the switch's actuation set point is reached at a. At this point, the membrane, converter and disc move axially with disc 24 snapping from the concave configuration facing membrane 14 to the opposite convex configuration facing the membrane thereby breaking the electrical engagement between the disc and the disc seat, as shown in FIG. 3.

Figure 2:
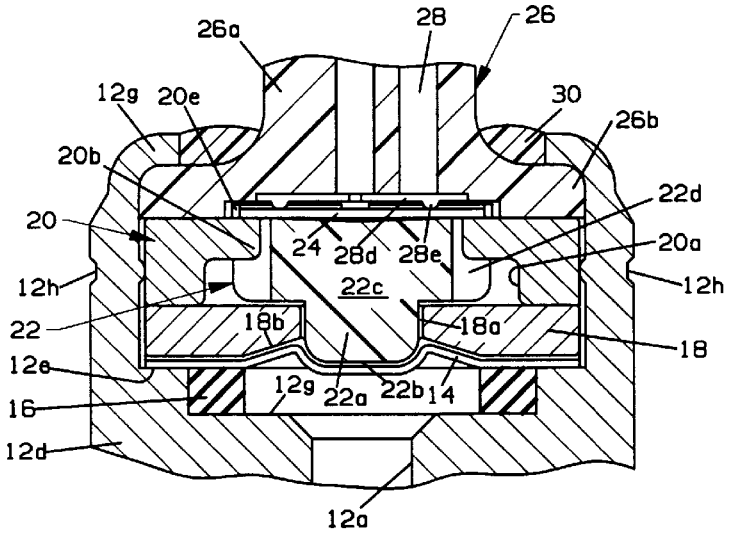
FIGS. 2 and 3 are broken away portions of FIG. 1 showing the switch in the closed circuit condition and the open circuit condition, respectively.

As system pressure is decreased, the membrane, converter and disc will follow the lower line on the device curve as shown in FIG. 7. At the release set point b, these components will snap back from the open circuit condition to the closed circuit condition with disc 24 again in electrical engagement with the disc seat 20 as shown in FIG. 2.

Figure 6:
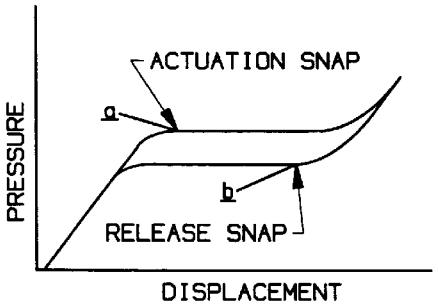
FIGS. 6 and 7 are pressure vs. displacement curves of a free disc and a switch mounted disc, respectively.

By selecting the distance between the planes of the disc seat and the terminal rib to be such that a selected pre-load is applied to the disc the corresponding pre-actuation travel is significantly reduced as can readily be seen by comparing the displacement of a free disc prior to actuation at a shown in FIG. 6.

Figure 3:
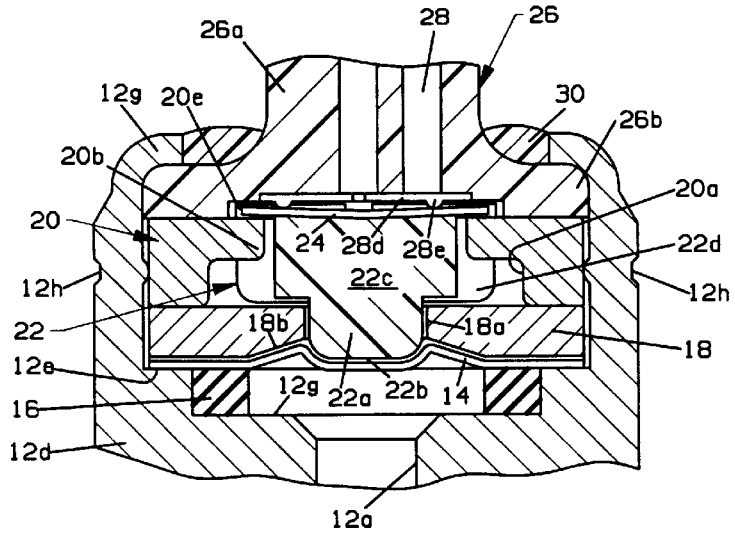
Figure 4:
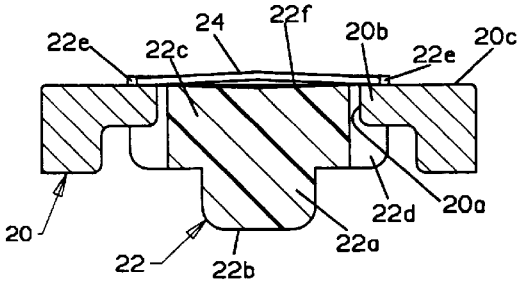
FIG. 4 is a view, as seen in FIGS. 1–2, of the disc, disc seat and pressure/force converter.

The movement of disc 24 is also limited in the FIG. 3, actuated, position. The provision of the shallow, concave recess 22*f* of converter 22 supports the disc in the actuated position preventing over-travel and the resultant bending stress in the disc which could exceed the elastic limit of the disc material. It will be understood that the disc is originally formed into a precise, dished configuration resulting in a specific, calibrated actuation and de-actuation set points. Without the provision of support surface 22*f*, the disc could be reformed thereby changing the device's calibrated set (actuation/de-actuation) points. The recess angle of surface 22*f* is selected to support the disc directly aligned with the terminal rib thereby limiting the bending stress in the disc by allowing the converter to support the disc during any pressures above the actuation pressure.

Limiting the travel of the disc both in the pre and post travel of the disc also results in reducing membrane travel thereby enhancing the life of the membrane. In prior art devices the travel of the disc was generally a function of using the disc as the make and break element of the circuit with a displacement similar to that shown in FIG. 6, resulting in greater membrane travel and concomitant shortening of the useful life of the membrane.

The feature of the interdigitating fingers 20*b*, 22*d* of the disc seat and converter respectively, facilitate assembling of the device while giving improved contact forces. That is , as shown in FIG. 1, the switch can be assembled by taking hexagonal body 12 in the direction shown in the drawing, inserting gasket 16, membrane 14, support plate 18, disc seat 20, converter 22, disc 24 and finally base 26. Utilizing this assembly approach, the converter interleaves with the disc seat providing a selected number of distinct contact points, i.e., four as shown, thereby concentrating the electrical contact force at these points.

Disc centering lip 22*e* of converter 22 extending above disc seat surface 20*c* captures and radially aligns the disc during and after assembly. This eliminates relative radial motion of the disc and converter at the outer diameter of the disc thereby reducing variability in the switch's set point and minimizing generation of wear particles at this interface.

Figure 8:
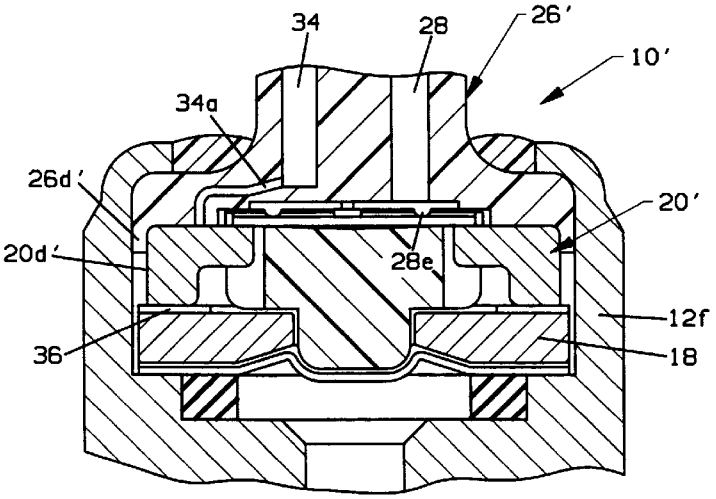
FIG. 8 is a view similar to FIG. 2 showing an alternative embodiment.

FIG. 8 shows a switch 10' made in accordance with an alternate embodiment of the invention. Instead of a single terminal, body ground pressure switch of FIG. 1, it is desired in some applications to provide a switch having a two terminal connection in order to eliminate or reduce the potential for body ground float, i.e., the characteristic of a ground point to be at an electrical potential which is above battery ground. Switch 10' is provided with a second elongated terminal 34 which extends through connector base 26, electrically isolated from connector 28, and electrically connected to disc seat 20' in any suitable manner via leg 34*a*, as by being biased into electrical engagement with disc seat 20' by the clamping force generated by crimp 12*g* of body wall 12*f*. The outer diameter 20*d'* of the disc seat is reduced and maintained out of engagement with sidewall 12*f* by an extended wall 26*d'* of connector base 26'. An electrically insulative spacer 36 of mylar or the like is disposed between support plate 18 and disc seat 20' so that the electrical path is from terminal 28 via terminal rib 28*e* to disc 24, from the disc to disc seat 20' and from the disc seat to terminal 34.

Though the invention has been described with respect to specific preferred embodiments, many variations and modifications will be apparent to those skilled in the art. It is therefore the intention that the appended claims be interpreted as broadly as possible consistent with the prior art to include such variations and modifications.

What is claimed:

1. A normally closed, fluid pressure responsive electric switch for use with a fluid pressure source comprising:

a body member having a central portion and first and second end portions, a recess formed in the central portion forming a fluid pressure chamber, a shelf extended around the perimeter of the recess, an orifice extending between the first end portion and the recess, a generally cylindrical wall extending from the central portion to a distal end at the second end portion forming a switch cavity, a flexible, impervious membrane disposed on the shelf and extending over the recess, an annular support plate having a centrally disposed bore therethrough, the bore having a longitudinal axis, the support plate having an outer periphery received on the membrane in alignment with the shelf, a pressure/force converter having first and second portions between first and second ends, the first portion being generally cylindrical slidably received in the bore of the support plate with the first end of the converter engageable with the membrane, the second end of the converter having a circular force applying surface of a selected diameter, the second portion having a plurality of fingers extending radially outwardly, the fingers having an outer distal end with a disc centering lip formed on the outer distal end of each finger extending in a direction away from the first end portion of the converter, an electrically conductive disc seat received on the annular support plate, the disc seat having first and second ends and a non-circular aperture extending between the ends, the non-circular aperture having a plurality of fingers extending radially inwardly from an outer periphery, the fingers of the disc seat being interdigitated with the fingers of the converter, the disc seat having a disc receiving surface lying in a plane, an electrically insulative base member having a first end received on the disc seat with the distal end of the cylindrical wall of the body member clampingly engaging the base member, the first end of the base member having a recessed portion, a first elongated terminal member extending from outside the base member through the base member into the recess, a terminal rib forming at least a segment of a circle having a selected diameter lying in plane generally parallel with the plane in which the disc receiving surface lies, and a snap acting, electrically conductive disc disposed on the disc receiving surface and maintained in a centered position by the disc centering lips, the disc having a concave dished shape facing the converter when exposed to fluid pressures below a selected level with the disc engaging the terminal rib and the outer periphery of the disc engaging the disc seat and snapping to a convex dished shape facing the converter when exposed to fluid pressures above the selected level with the outer periphery of the disc out of engagement with the disc seat.

2. A normally closed, fluid pressure responsive electrical switch according to claim 1 in which the cylindrical wall of the body member is deformed into electrical engagement with the disc seat.

3. A normally closed, fluid pressure responsive electrical switch according to claim 1 in which the distance between the disc receiving surface of the disc seat and the terminal rib in a direction parallel to the longitudinal axis of the switch is selected to be less than the distance between a plane in which a free snap acting disc lies and a parallel extending plane tangent to the center of the disc.

4. A normally closed, fluid pressure responsive electrical switch according to claim 1 in which the second end of the converter has a face surface shaped with a slightly concave, smooth configuration to prevent over-stressing of the disc.

5. A normally closed, fluid pressure responsive electrical switch according to claim 1 further comprising a second elongated terminal member which extends from outside the base member, through the base member, spaced from the first terminal member, the second terminal member having a distal end portion engaging the disc seat, and an electrically insulative spacer disposed between the annular support plate and the disc seat, the electrically insulative base member having a wall portion extending from the first end disposed between the disc seat and the cylindrical wall of the body member.

6. A normally closed, fluid pressure responsive electrical switch according to claim 1 in which the diameter of the terminal rib is selected to be less than the diameter of the circular force applying surface of the converter.

7. A normally closed, fluid pressure responsive electric switch for use with a fluid pressure source comprising:

a body member having a central portion and first and second end portions, a recess formed in the central portion forming a fluid pressure chamber, a wall extending from the central portion to a distal end at the second end portion forming a switch cavity, a flexible, impervious membrane extending over the recess, separating the fluid pressure chamber and the switch cavity, a pressure/force converter having a circular force applying surface of a selected diameter and having a plurality of fingers extending radially outwardly, the fingers having an outer distal end with a disc centering lip formed on the outer distal end of each finger extending in a direction away from the first end portion of the converter, an electrically conductive disc seat received in the body member having first and second ends and a non-circular aperture extending between the ends, the non-circular aperture having a plurality of fingers extending radially inwardly from an outer periphery, the fingers of the disc seat being interdigitated with the fingers of the converter, the disc seat having a disc receiving surface, an electrically insulative base member having a first end received on the disc seat with the distal end of the wall of the body member clampingly engaging the base member, the first end of the base member having a recessed portion, a first elongated terminal member extending from outside the base member through the base member into the recess to form a contact surface, and a snap acting, electrically conductive disc disposed on the disc receiving surface and maintained in a centered position by the disc centering lips, the disc having a concave dished shape facing the converter when exposed to fluid pressures below a selected level with the disc engaging the contact surface and the outer periphery of the disc engaging the disc seat and snapping to a convex dished shape facing the converter when exposed to fluid pressures above the selected level with the outer periphery of the disc out of engagement with the disc seat.

8. A normally closed, fluid pressure responsive electrical switch according to claim 7 in which the wall of the body member is deformed into electrical engagement with the disc seat.

9. A normally closed, fluid pressure responsive electrical switch according to claim 7 in which the distance between the disc receiving surface of the disc seat and the contact surface in a direction parallel to the longitudinal axis of the switch is selected to be less than the distance between a plane in which a free snap acting disc lies and a parallel extending plane tangent to the center of the disc.

10. A normally closed, fluid pressure responsive electrical switch according to claim 7 in which the second end of the converter has a face surface shaped with a slightly concave, smooth configuration to prevent over-stressing of the disc.

11. A normally closed, fluid pressure responsive electrical switch according to claim 7 further comprising a second elongated terminal member which extends from outside the base member, through the base member, spaced from the first terminal member, the second terminal member having a distal end portion engaging the disc seat, and an electrically insulative spacer disposed between the annular support plate and the disc seat, the electrically insulative base member having a wall portion extending from the first end disposed between the disc seat and the wall of the body member.

12. A normally closed, fluid pressure responsive electrical switch according to claim 7 in which the contact surface is at least a segment of a circular terminal rib having a diameter selected to be less than the diameter of the circular force applying surface of the converter.

13. A normally closed, fluid pressure responsive electric switch according to claim 1 in which the terminal rib has a first and a second end spaced from one another and the rib extends to a height at a selected axial location and a disc supporting projection is formed in the base member between the first and second ends of the terminal which extends to a height generally at the said selected axial location.

* * * * *